United States Patent [19]

Davis et al.

[11] 4,289,636

[45] Sep. 15, 1981

[54] AQUEOUS LUBRICANT COMPOSITIONS

[75] Inventors: Robert H. Davis, Pitman; Alfred B. Piotrowski, Woodbury, both of N.J.

[73] Assignee: Mobil Oil Corporation, New York, N.Y.

[21] Appl. No.: 80,713

[22] Filed: Oct. 1, 1979

[51] Int. Cl.[3] ..... C10M 1/06

[52] U.S. Cl. ..... 252/49.3; 252/49.5; 252/51.5 A

[58] Field of Search ..... 252/49.3, 51.5 A, 34.7, 252/49.5, 34

[56] References Cited

U.S. PATENT DOCUMENTS

| | | | |
|---|---|---|---|
| 2,490,744 | 12/1949 | Trigg et al. | 252/34 |
| 2,939,842 | 6/1960 | Thompson | 252/34 X |
| 2,959,547 | 11/1960 | Brillhart | 252/49.3 X |
| 3,256,187 | 6/1966 | Davis | 252/34.7 X |
| 3,269,946 | 8/1966 | Wiese | 252/51.5 A X |
| 3,378,494 | 4/1968 | Berger | 252/49.5 X |
| 3,629,112 | 12/1971 | Gower et al. | 252/49.3 X |
| 3,645,897 | 2/1972 | Gower et al. | 252/49.3 X |
| 3,983,044 | 9/1976 | Felton, Jr. | 252/49.3 X |
| 4,053,426 | 10/1977 | Davis et al. | 252/34.7 X |

FOREIGN PATENT DOCUMENTS

| | | | |
|---|---|---|---|
| 1165086 | 9/1969 | United Kingdom | 252/49.3 |

*Primary Examiner*—Andrew Metz

*Attorney, Agent, or Firm*—C. A. Huggett; M. G. Gilman; H. M. Flournoy

[57] ABSTRACT

Improved water soluble lubricant compositions are provided by incorporating therein amides derived from alkylamines and succinic, tetrahydrophthalic or tetrahydrofuran tetracarboxylic acids.

11 Claims, No Drawings

AQUEOUS LUBRICANT COMPOSITIONS

BACKGROUND OF THE INVENTION

1. Field of the Invention

This invention relates to lubricant compositions and more particularly to water-soluble lubricant compositions adapted for use as lubricants and coolants in metal machining operations.

2. Description of the Prior Art

In the machining of metals (turning and drilling etc.) it is often necessary to have a liquid flowing over the contact of workpiece and tool, in order to provide cooling and lubrication and to wash away the chips. The fluids used are of two general types, soluble cutting oils and straight cutting oils. In some cutting operations, such as turning and grinding, cooling is more important than lubrication. Water is the best coolant known, and at one time water or an aqueous soap solution was used for this purpose. Such liquids possess poor lubricating properties, however, and moreover lead to rusting when used with ferrous metals. Consequently, 'soluble' oils were developed for this kind of operation. They consist of mixtures of mineral oils and emulsifiers which can be diluted with water to form stable emulsions over a wide range of concentrations and possess the good cooling properties of water, while containing sufficient oil to provide lubrication. They are normally used as dilute emulsions, which circulate over the seat of the cutting operation and, besides cooling and lubricating, carry away the metal particles formed. A number of emulsifiers can be used, but one of the best types is a petroleum soap (i.e. sodium naphtha-sulphonates), made from the aromatics produced in the refining of medicinal oils, transformer oils and white oils. More recently there has been a tendency to return to improved forms of aqueous solutions free from some of the deficiencies of their earlier counterparts.

It is customary to employ these coolants in combination with various agents having lubricating and extreme-pressure properties for reducing friction between the tool and workpiece, particularly in operations such as tapping and broaching. Such aqueous cutting fluids, in order to perform satisfactorily, should meet certain important requirements.

Among the requirements for a satisfactory aqueous cutting fluid are corrosion-inhibiting properties for ferrous and cuprous alloys, and also stability under the conditions of operation. There are, however, further important requirements that should also be met. Among these requirements is the ability to avoid leaving deposits on the tool and the work following the machining operation which result from subsequent drying of the fluid and which are difficult to remove. Other important requirements include tolerance in hard water solutions so that the precipitation of lubricant components will not occur, avoidance of tacky residues which interfere with the operation of the machine and avoidance of excessive foam formation. Aqueous metal working fluids known prior to this invention have not, however, proven satisfactory for all of the foregoing requirements.

U.S. Pat. No. 3,723,313 teaches lubricants for metal working that contain an aromatic oil and a mixture of mono- and dialkyl phosphates, the alkyl groups having 8 to 20 carbon atoms. U.S. Pat. No. 3,523,895 teaches an emulsion lubricant on a water-free basis from about 20–50% by weight of the neat composition of a solid aliphatic monocarboxylic acid having from 10 to 30 carbon atoms. There are, however, no such aqueous systems incorporating amides derived from amines as disclosed and claimed in accordance herein.

SUMMARY OF THE INVENTION

In accordance with this invention an improved water-soluble lubricant comprising an aqueous amine soap solution of amide/acid is provided, the improvement comprising incorporating into said lubricant a minor effective amount of an amide derived from an amine and succinic, tetrahydrophthalic or tetrahydrofuran tetracarboxylic acids.

DESCRIPTION OF SPECIFIC EMBODIMENTS

Accordingly, the improved lubricants used in this invention are aqueous compositions comprising water and a minor effective amount of a water-soluble amide derived from primary and secondary alkyl amines and succinic, tetrahydrophthalic or tetrahydrofuran tetracarboxylic acids. The amide so derived is a highly effective corrosion or antirust inhibitor. Aqueous lubricant formulations containing the amide in combination with other known special purpose additives described above provide a blend having good hard water stability characterstics.

Any, preferably liquid, primary or secondary alkyl amine is suitable for use herein. A non-exhaustive list includes propylamine, butylamine, propylmethylamine, ethylamine, hexylamine, ethylhexylamine, di-2-ethylhexylamine and the like. Preferable are amines containing from 1 to 30 carbon atoms in the alkyl moiety and as previously stated liquid at room temperature.

The organic acid component as also previously stated is preferably selected from acids such as succinic acid, tetrahydrophthalic acid and tetrahydrofuran tetracarboxylic acids.

The lubricant will also normally contain other selected additives for their known purpose. For example, the lubricant formulation will generally contain a water-soluble alkanolamine which may be of any molecular weight but should, preferably, be liquid at room temperature. The lower molecular weight compounds are generally preferred and, for this purpose, it has been found that such alkanolamines as mono-, di- or triethanolamine are most effective. Other water-soluble alkanolamines may also be employed, and include such alkanolamine as isopropanolamines, e.g., mono-, di- and triisopropanolamine, dimethylethanolamine, diethylethanolamine, aminoethylethanolamine, N-acetylethanolamine, phenylethanolamine, phenyldiethanolamine and mixtures thereof. If so desired, and in order to impart increased anti-rust properties to the aqueous lubricant composition, an alkali metal nitrite may also be employed in the formulation. In this respect, it is found that more specific increased resistant to copper corrosion may also be obtained by the additional use of the sodium salt of mercapto-benzothiazole, benzotriazole or tolutriazole. The novel formulation may also include a wide variety of germicidal agents for inhibiting bacterial growth. For this purpose, the germicidal agent may comprise, for example, a halogenated cresol, either completely or partially halogenated cresol, and may include such representative compounds as completely or partially chlorinated, brominated, fluorinated or iodated cresols. Typical examples of this class of materials include: chloro-, dichloro-, trichloro- and tetrachlorocresols; bromo- dibromo-, tribromo, and tetrabromo-cresols, or any of the aforementioned compounds in which the chlorine or bromine atoms are substituted in whole or in part by fluorine or iodine. More specific compounds include: para-chloro-meta-cresol; para-bromo-meta-cresol; para-fluoro-meta-cresol, 2,4-dibromo-meta-cresol; 2,4,5-trichloro-meta-cresol; 2,4,5,6-tetrachlorometa-cresol; 2,4-dibromo-meta-cresol; 2,4,5-tribromo-meta-cresol; 2,4,5,6-tetrabromo-meta-cresol; or any of the aforementioned compounds in which the chlorine or bromine atoms are substituted in whole or in part by fluorine or iodine; or any corresponding ortho or para-cresols of the aforementioned compounds substituted for the corresponding meta-cresols.

Other germicidal agents that may be employed in the above-described novel formulations may include aldehydes, such as formaldehyde, or aldehyde-releasing agents such as formaldehyde-releasing agents, i.e., materials which break down is storage to form the aldehyde or aldehyde compounds as decomposition products. Thus, it is found that compounds such as tris(hydroxymethyl) nitromethane are particularly effective in releasing formaldehyde and thereby providing germicidal protection over relatively long periods of time. Other microbicidal gases that may be employed for this purpose include ethylene oxide and beta propiolactone. Alcohols such as methyl alcohol, ethyl alcohol or higher alcohols may also be employed as germicidal agents. Other effective germicidal agents include halogens and halogen compounds, particularly iodine and chlorine and compounds of these halogens. Specific compounds of this type may include chloride of lime and iodophors. Furthermore, as germicidal agents, compounds of heavy metals may include such compounds as bichloride of mercury and organic mecurials such as Mercurochrome, Merthiolate, Metaphen, silver nitrate and copper sulfate. Germicidal agents comprising phenol and its derivatives may also be employed in the novel formulations, which include the aforementioned cresols and bis-phenols. Synthetic detergents may also be employed as germicidal agents, which are of the non-phenolic type. These may include, for example, ammonium halides, such as ammonium chloride, in which the hydrogen atoms have been replaced by organic radicals; particularly effective are quaternary compounds in which the long-chain organic radical (alkyl group) contains from 12 to 16 carbon atoms. Other materials include quaternary compounds in which the organic group is an anion, e.g., sodium lauryl-sulfate, as well as those compounds which do not ionize.

The lubricant will normally contain a load support agent. Included among such agents are the polyoxyalkylene glycols. The preferred members include water-soluble oils obtained by copolymerizing mixtures of ethylene oxide and propylene oxide, e.g., oils prepared by copolymerizing a 50—50 mixture of ethylene oxide and propylene oxide; water-soluble heteric copolymeric alkylene glycols, ethers or esters thereof, wherein the different oxyalkylene units are substantially randomly distributed throughout the entire polyoxyalkylene chain; water-soluble polyoxylalkylene compounds containing hydrophobic homopoly-oxyalkylene units; and polymeric agents in general, which are block copolymers of cogeneric mixtures of conjugated polyoxyalkylene compounds containing at least one hydrophobic homopolyoxyalkylene unit, having a unit weight of at least about 800, and one or two other hydrophilic polymeric units which comprise from about 15 to about 90 percent of the total polymeric compound. The most desirable water-soluble polyoxyalkylene glycols for use in the formulations of the present invention comprise the polyether polyols produced by reacting ethylene oxide and propylene oxide having hydroxyl number from about 22 to about 38.

Preferable for use as plasticizing agents are polyalkylene glycols. Diethylene glycol has proven to be most satisfactory in this respect.

The novel lubricant compositions of the present invention are formulated in accordance with certain balanced proportions expressed in weight percent. The amides are employed in an amount from about 5 to about 40 percent, and preferably in an amount from about 15 to about 30 percent, by weight. The alkanolamine is employed in an amount from about 5 to about 50 percent, and preferably in an amount from about 20 to about 40 percent, by weight. The polyoxyalkylene glycol is employed in an amount from about 0.5 to about 20 percent, and preferably in an amount from about 0.5 to about 3 percent, by weight. Where a germicidal agent is also to be incorporated in the novel formulation, these agents are employed in an amount from about 0.05 to about 5 percent, and preferably in an amount from about 0.5 to about 3 percent, by weight. When the alkali metal nitrite is to be included in the formulation, it is generally employed in an amount from about 0.1 to about 10 percent, and preferably in an amount from about 0.1 to about 5 percent, by weight. When benzotriazole is to be included in the formulation, it is generally present in an amount from about 0.1 to about 5 percent, and preferably from about 0.1 to about 2 percent, by weight. If so desired, other additives for enhancing rust protection or for the purpose of changing the pH of the system may be employed. Such additional additives may include boric acid, borate esters or oxides of boron for enhancing rust protection, and are generally employed in an amount from about 0.1 to about 5 percent, and preferably from about 0.1 to about 3 percent, by weight. For raising the pH of the system, such additional additives may be employed in the form of alkali metal hydroxides, including more specifically, sodium, lithium or potassium hydroxide. When the latter are present, they are generally employed in an amount from about 0.1 to about 3 percent, and preferably from about 0.1 to about 1.5 percent, by weight. Furthermore, if so desired, various water-soluble chelating agents may be employed to soften the water vehicle. These may include, for example, salts of ethylenediamine tetraacetic acid, nitrilo-triacetic acid or diethylene triamine pentaacetic acid. When any of the aforementioned chelating agents are employed, they are generally present in an amount from about 0.1 to about 5 percent, by weight. In each instance, of course, it will be apparent that sufficient water is employed in order to balance the formulation.

EXAMPLE 1

Preparation of Di-di-2-Ethylhexylamide of Tetrahydrofuran-2,3,4,5-Tetracarboxylic Acid 111.63 g (0.5 Moles) of tetrahydrofuran-2,3,4,5-tetracarboxylic dianhydride and 242.0 g (1-mole) of di-2-ethylhexylamine in a round bottom flask and heated to 90° C. for 15 minutes, then gradually heated to 135° C. and held at 135° C. with stirring for 3–4 hours and thereafter recovered. Theoretical acid value of product is 161.4.

EXAMPLE 2

Preparation of Mono-di-2-Ethylhexylamide of cis-1,2,3,6-Tetrahydrophthalic Acid 152.15 g (1 Mole) of cis-1,2,3,6-tetrahydrophthalic anhydride was placed in a round bottom flask with 241.5 g (1 mole) of di-2-ethylhexylamine added thereafter. The mixture was first heated to 90° C. for fifteen minutes and then gradually to 135° C. and held at 135° C. with stirring for 3–4 hours. Theoretical acid value of product is 142.53.

EXAMPLE 3

Preparation of Mono-di-2-Ethylhexylamide of Succinic Acid 100.04 g (1 Mole) of succinic anhydride and 241.5 g (1 mole) of di-2-ethylhexylamine were placed in a round bottom flask. Heated to 90° C. for fifteen minutes, then gradually to 135° C. and held at 135° C. with stirring for 3–4 hours and thereafter recovered. Theoretical acid value of product is 164.26.

Corrosion Test

One to three grams of malleable iron chips are placed on a filter paper in a glass petri dish, 10 grams of test fluid which is to be evaluated is placed on the chips and allowed to stand at a temperature of about 70° F. for a period of about 24 hours. After this period the sample is then checked for the appearance of rust. The samples are graded from 0 (no rust) to 3 (severe rusting) in accordance with the following standard chart.

| Description | Rating |
|---|---|
| No rusting, or less than 1% of the metal surface coated with yellow iron oxide | 0 |
| Light rusting, rusting confined to not more than six spots, each of which is 1 mm. or less in diameter | 1 |
| Moderate rusting, rusting in excess of the above, but confined to less than 5% of the surface of the specimen | 2 |
| Severe rusting, rusting covering more than 5% of the surface of the specimen | 3 |

The results are shown in the following table:

TABLE 1

| | Lubricant Composition | | | | | | | | | |
|---|---|---|---|---|---|---|---|---|---|---|
| | | | | | | | | Malleable Iron Rust Test-Dilutions in Distilled Water** | | |
| Example | DEA[1] Wt. % | TEA[2] Wt. % | Mono-Di-2-Ethylhexyl amide of Succinic Acid[3] Wt. % | Mono-Di-2-Ethylhexyl-amide of Cis- 1,2,3,6-Tetrahydrophthalic Acid[3] Wt. % | Di-Di-2-Ethylhexyl-amide of Tetrahydrofuran-2,3,4,5-tetra-carboxylic acid[3] Wt. % | Glycol* Wt. % | Water, Wt. % | 60:1 | 90:1 | 120:1 |
| 1 | 18.5 | 20.5 | 22.0 | — | — | 15.0 | 20.25 | 0 | 1 | 1 |
| 2 | 18.5 | 20.5 | — | 22.0 | — | 15.0 | 20.25 | 0 | 1 | 1 |
| 3 | 18.5 | 20.5 | — | — | 22.0 | 15.0 | 20.25 | 0 | 1 | 1 |
| 4 | 18.5 | 20.5 | — | — | — | 15.0 | 20.25 | — | — | — |

[1]Diethanolamine
[2]Triethanolamine
[3]Each Example contained 1.9 wt. % of an ethylene oxide-propylene oxide copolymer having a molecular weight of 2180, 0.25 wt. % of benzotriazole, 1.5 wt. % of a triazine type aldehyde releaser and 0.1% of an odorant.
*Diethylene glycol
**Parts of composition to parts of distilled water The novel lubricant compositions in accordance with this invention are preferably prepared, when an alkanolamine as described above is included therein, by a blending procedure which comprises mixing the alkanolamine and the amide component with about 10 to about 20 parts of water, which is to be present in the finished formulation. This blending procedure may be carried out at room temperature. However, heating to 120° F. with agitation is more satisfactory. The remaining quantity of water required to be present in the finished product is added, together with the polyoxyalkylene glycol, and any of the aforementioned other desired components. It should be noted, however, that if an alkali metal nitrite is to be present in the finished product, such material is added last for the reason that addition of acids such as caprylic acid to a solution of sodium nitrite could result in decomposition of the nitrite, thus reducing or nullifying its rust-inhibiting effects. If a germicidal agent is to be incorporated in the novel formulation, it is preferably blended with the alkanolamine and organic acid.

The compounding of the novel compositions of the present invention may be illustrated by the preparation of lubricant and cutting fluids from the formulations in the following table and examples and which also include comparative data. They were tested in a corrosion test, as follows:

We claim:

1. An improved water-soluble lubricant comprising an effective anti-corrosion or anti-rust amount of a water-soluble amide derived from the reaction of a $C_1$–$C_{30}$ primary alkyl amine or a $C_1$–$C_{30}$ secondary alkyl amine with a member selected from the group consisting of tetrahydrophthalic acid, tetrahydrofuran tetracarboxylic acid, tetrahydrophthalic acid anhydride and tetrahydrofuran tetracarboxylic acid anhydride and water to make the balance of the composition.

2. The lubricant of claim 1 wherein said amine is di-2-ethylhexylamine.

3. The lubricant of claim 2 wherein the amide is derived from said amine and a tetrahydrophthalic acid or anhydride.

4. The lubricant of claim 2 wherein said amide is mono-di-2-ethylhexylamide of cis-1,2,3,6,-tetrahydrophthalic acid.

5. The lubricant of claim 2 wherein the amide is derived from said amine and a tetrahydrofuran tetracarboxylic acid or dianhydride.

6. The lubricant of claim 5 wherein said amide is di-di-2-ethylhexylamide of tetrahydrofuran-2,3,4,5-tetracarboxylic acid.

7. A water-soluble lubricant composition comprising about 5–40 wt. % of a water-soluble amide derived from the reaction of a $C_1$–$C_{30}$ primary or secondary alkyl amine and a member selected from the group consisting of tetrahydrophthalic acid tetrahydrofuran tetracarboxylic acid tetrahydrophthalic acid anhydride and tetrahydrofuran tetracarboxylic acid anhydride, 5–50 wt. % of a water-soluble mono-, di- or tri-alkanolamine, about 0.5 to 20 wt. % of a water-soluble polyoxyalkylene glycol containing at least one homopolyalkylene unit having a unit weight of at least about 800 and water to make the balance of the composition.

8. The composition of claim 7 having about 15–30 wt. % of the amide, about 20–40 wt. % of the amine and about 0.5–3 wt. % of the polyoxyalkylene glycol.

9. The lubricant of claim 7 wherein the glycol is a copolymer of ethylene and propylene oxides.

10. The lubricant of claim 7 wherein the alkanolamine is diethanolamine.

11. The lubricant of claim 7 wherein the alkanolamine is triethanolamine.

* * * * *